US012409360B2

(12) United States Patent
Simon

(10) Patent No.: US 12,409,360 B2
(45) Date of Patent: Sep. 9, 2025

(54) PUSH AND PULL EXERCISE DEVICE AND METHODS OF USE

(71) Applicant: Marc Simon, Oxford, GA (US)

(72) Inventor: Marc Simon, Oxford, GA (US)

( * ) Notice: Subject to any disclaimer, the term of this patent is extended or adjusted under 35 U.S.C. 154(b) by 169 days.

(21) Appl. No.: 18/385,179

(22) Filed: Oct. 30, 2023

(65) Prior Publication Data

US 2025/0135266 A1 May 1, 2025

(51) Int. Cl.
*A63B 21/00* (2006.01)
*A63B 23/035* (2006.01)
*A63B 23/12* (2006.01)

(52) U.S. Cl.
CPC .... *A63B 21/4035* (2015.10); *A63B 23/03525* (2013.01); *A63B 23/12* (2013.01); *A63B 21/4045* (2015.10)

(58) Field of Classification Search
CPC ..... A63B 7/00; A63B 7/02; A63B 21/072; A63B 21/0726; A63B 21/4019; A63B 21/4035; A63B 21/4045; A63B 23/03525; A63B 23/12; A63B 23/1218; A63B 23/1227; A63B 2244/09
See application file for complete search history.

(56) References Cited

U.S. PATENT DOCUMENTS 3,068,001 A * 12/1962 Portman ..... A63B 21/0023 482/91
3,369,809 A * 2/1968 Morrill, Jr. ..... A63B 21/0023 482/131
3,843,119 A * 10/1974 Davis ..... A63B 21/154 482/131
3,850,431 A * 11/1974 Winans ..... A63B 21/4011 482/99
D262,730 S * 1/1982 Lambert, Jr. ..... D21/694
4,509,746 A * 4/1985 Mask ..... A63B 21/4029 482/142
5,350,345 A * 9/1994 Frey ..... A63B 21/4035 482/93
5,453,067 A * 9/1995 Cianfrocca, II ... A63B 21/4001 482/99
5,761,767 A * 6/1998 Barton ..... A45C 13/26 16/901
6,149,559 A * 11/2000 Mackey ..... A63B 21/16 482/904
D565,133 S * 3/2008 Mollet ..... D21/694
D617,401 S * 6/2010 Kulka ..... D21/692
(Continued)

OTHER PUBLICATIONS

Granite Fitness flat push down bar (https://granite-fitness.com/products/free-shipping-granite-fitness-flat-push-down-palm-bar-carabiner) (Year: 2022).*

*Primary Examiner* — Gary D Urbiel Goldner
(74) *Attorney, Agent, or Firm* — Mathew L. Grell, Esq.; Grell & Watson Patent Attorneys LLC

(57) ABSTRACT

A push and pull exercise device having a lateral flat surface configuration to enable a user to sandwich grip the lateral flat surface between an underside of outstretched fingers and a thumb or by contact with a palm side of the outstretched fingers and/or palms of both left and right hands, the lateral flat surface having a ringlet positioned approximately in a middle of the lateral flat surface, and thus, to exercise biceps, shoulders, and/or forearm muscles or sets of muscles, or a specific range or section of those muscles.

12 Claims, 12 Drawing Sheets

(56) References Cited

U.S. PATENT DOCUMENTS

| | | | | |
|---|---|---|---|---|
| 8,894,556 | B2 * | 11/2014 | Webb | A63B 21/075 482/126 |
| 9,873,013 | B2 * | 1/2018 | Williams | A63B 21/0023 |
| 10,426,994 | B1 * | 10/2019 | Campanaro | A63B 21/068 |
| 11,033,773 | B1 * | 6/2021 | Barton | A63B 23/1281 |
| D949,256 | S * | 4/2022 | Barton | D21/679 |
| D1,028,135 | S * | 5/2024 | Senatus | D21/679 |
| 2002/0068666 | A1 * | 6/2002 | Bruccoleri | A63B 21/00 482/93 |
| 2005/0113223 | A1 * | 5/2005 | Dovner | A63B 21/0004 482/121 |
| 2006/0211552 | A1 * | 9/2006 | Williams | A63B 21/4017 482/93 |
| 2007/0184950 | A1 * | 8/2007 | Bradley | A63B 21/4035 482/141 |
| 2012/0129665 | A1 * | 5/2012 | Walker | A63B 21/00047 482/139 |
| 2024/0100393 | A1 * | 3/2024 | Hollier | A63B 21/00185 |

* cited by examiner

PUSH AND PULL EXERCISE DEVICE AND METHODS OF USE

FIELD OF THE DISCLOSURE

The present disclosure is directed to an exercise device. More specifically, the present disclosure is directed to a push pull exercise device for use via an open hand finger grip.

BACKGROUND

A plurality of exercise devices are on the market today with a number of devices being created to focus on or isolate a specific muscle or set of muscles to enable a user to work out, exercise, or build up the specific muscle or set of muscles. Likewise, the triceps muscle, the large muscle group at the back of the upper arm, the latissimus dorsi muscles, known as the lats, are the large V-shaped muscles that connect your arms to your vertebral column, biceps is a large muscle situated on the front of the upper arm between the shoulder and the elbow, and forearms is the section of the upper limb from the elbow to the wrist, have specific devices and equipment available to enable a user to work out, exercise, or build up these muscle or sets of muscles.

A couple of previous approaches of triceps, biceps, forearms, and lats exercise devices includes a pair of spaced apart parallel bars used to perform dips, a curl bar to perform curls, and a cable machine grip attachment having a round bar to perform push down or pull up exercises. A disadvantage of this approach is that the user grips the bars with a curved hand grip which isolates the specific sections of their triceps, biceps, lats, and forearm muscles or sets of muscles in one specific way.

Therefore, it is readily apparent that there is a recognizable unmet need for a push and pull exercise device and methods of use that may be configured to address at least some aspects of the problems discussed above.

SUMMARY

Briefly described, in an example embodiment, the present disclosure may overcome the above-mentioned disadvantages and may meet the recognized need for a push and pull exercise device having a lateral flat surface configuration to enable the user to sandwich grip the surface between the underside of outstretched fingers and the thumb or by contact with the palm side of out stretched fingers and/or palm of both left and right hands, the flat or arching surface having a ringlet positioned approximately in the middle of the lateral flat surface.

Accordingly, in another aspect, the present disclosure may be configured having a multi-tiered configuration of left and right lateral flat surface configuration to enable the user to sandwich grip the surface between the underside of outstretched fingers and the thumb or by contact with the palm side of out stretched fingers and/or palm of both left and right hands, the first flat or arching surface having a ringlet positioned approximately in the middle of the lateral flat surface.

Accordingly, in another aspect, the present disclosure may be configured having an arching or spherical surface configuration to enable the user to contact the surface with the palm side of out stretched fingers and/or palm of both left and right hands, the arching or spherical surface having a ringlet positioned approximately in the middle of the lateral flat surface.

Accordingly, in another aspect, the present disclosure may be configured having an grooved or indentations on the surface configuration or the like to enable the user to grip the surface with the palm side of out stretched fingers and/or palm of both left and right hands, the surface having a ringlet positioned approximately in the middle of the lateral flat surface.

Accordingly, in another aspect, the present disclosure may be configured a lateral flat surface configuration to enable the user to sandwich grip the surface between the underside of outstretched fingers and the thumb or by contact with the palm side of out stretched fingers and/or palm of an individual hand, the flat or arching surface having a ringlet or D-ring positioned approximately in the middle of the lateral flat surface.

In another exemplary embodiment of the push and pull exercise device, the push and pull exercise device including a planar member having first planar end and second planar end with a center line there between the first planar end and the second planar end, the planar member having an upper surface and a front side edge, and a ringlet affixed to the planar member proximate the center line between the first planar end and the second planar end.

In another exemplary embodiment of the A push and pull exercise device, the push and pull exercise device including a planar member having first planar end and second planar end with a center line there between the first planar end and the second planar end, the planar member having an upper surface and a front side edge, a ringlet affixed to the planar member proximate the center line between the first planar end and the second planar end, and a first vertical support and a second vertical support, the first vertical support positioned proximate and extend therefrom the first planar end to support a third upper surface having a third planar end, and the second vertical support positioned proximate and extend therefrom the second planar end to support a fourth upper surface having a fourth planar end.

A feature of the present disclosure may include use as an attachment to a cable machine with different weight settings to select via a pin insertion.

A feature of the present disclosure may include use as an attachment to a cable or chain affixed to a weight.

A feature of the present disclosure may include dumbbell bar extensions extending from each side of the surface to add weights to each side of the device.

A feature of the present disclosure may include sandwich gripping the surface between the underside of outstretched fingers and the thumb or by contact with the palm side of fingers and/or palm of both left and right hands or an individual hand to add wrist, palm, and finger workouts to the exercise along with isolating the specific sections of their triceps, biceps, lats, front and rear deltoids, and forearm muscles or sets of muscles specific to this grip.

A feature of the present disclosure may include the ability to exhaust specific sections of their triceps, biceps, lats, front and rear deltoids, and forearm muscles or sets of muscles specific to this grip in an expedited time frame.

These and other features of a push and pull exercise device and methods of use will become more apparent to one skilled in the art from the prior Summary and following Brief Description of the Drawings, Detailed Description of exemplary embodiments thereof, and Claims when read in light of the accompanying Drawings or Figures.

BRIEF DESCRIPTION OF THE DRAWINGS

The present push and pull exercise device and methods of use will be better understood by reading the Detailed Description of the Preferred and Selected Alternate Embodiments with reference to the accompanying drawing Figures, in which like reference numerals denote similar structure and refer to like elements throughout, and in which.

Figure 1A:
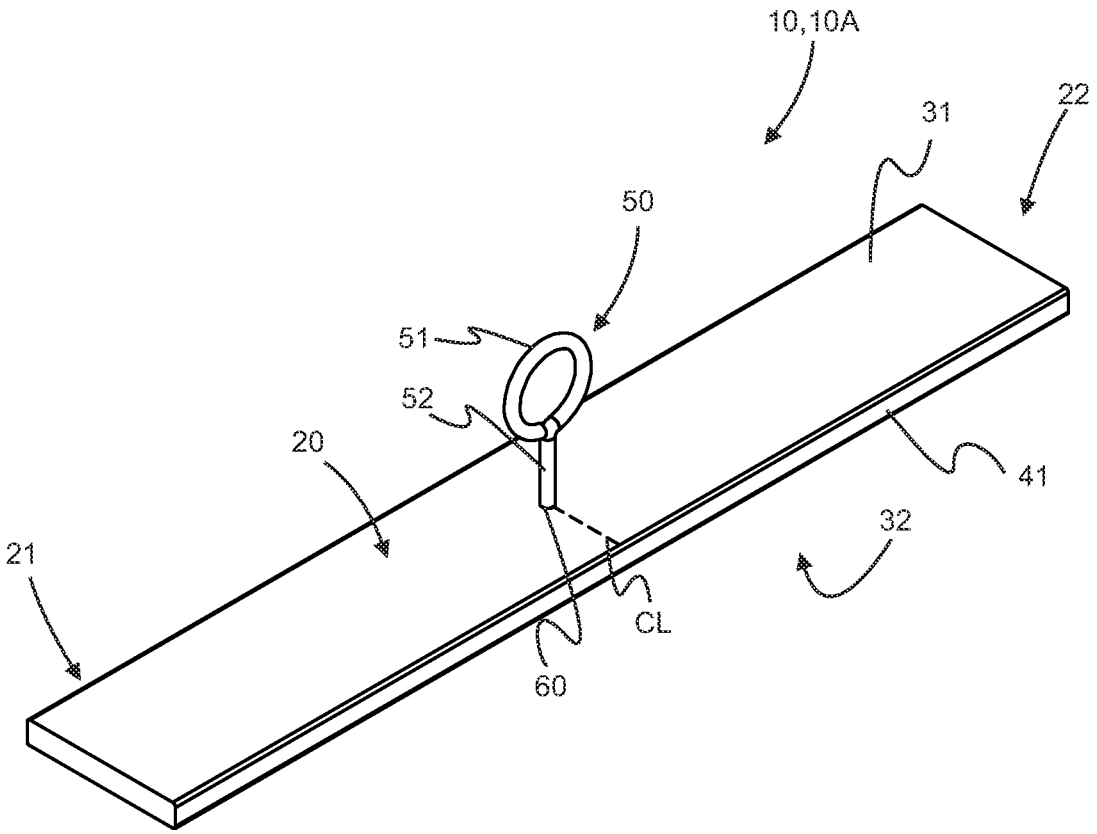
FIG. 1A is a perspective side view of the push and pull exercise device according to select embodiments of the instant disclosure.
Figure 1B:
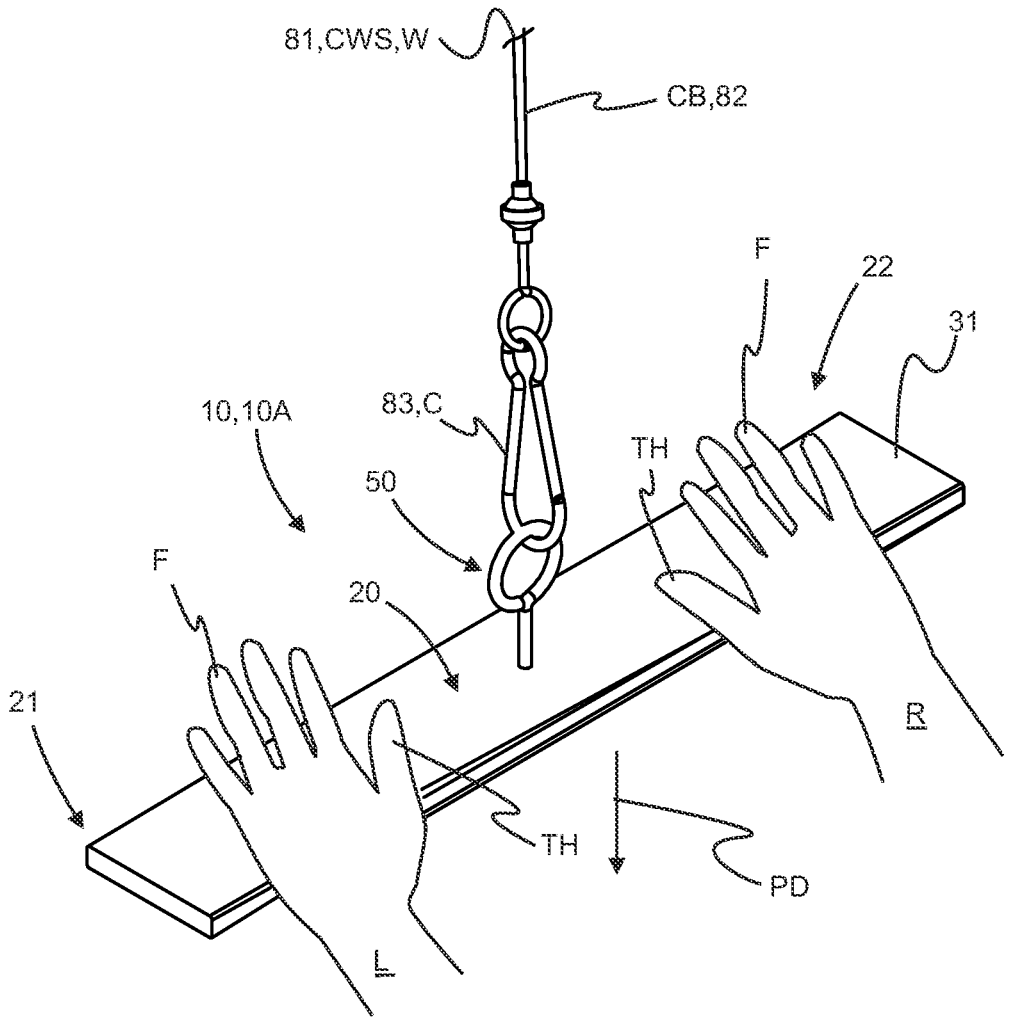
FIG. 1B is a perspective side view of the push and pull exercise device shown in use with a sandwich grip of the surface between the underside of outstretched fingers and the thumb of palm down according to select embodiments of the instant disclosure of FIG. 1A.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

In describing the exemplary embodiments of the present disclosure, as illustrated in the figures, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples.

With respect to the above description then, it is to be realized that the optimum dimensional relationships, to include variations in size, materials, shape, form, position, movement mechanisms, function and manner of operation, assembly and use, are intended to be encompassed by the present disclosure.

It is contemplated herein that push and pull exercise device 10 may be affixed or releasably affixed to cable CB, 82, cabled weight system CWS, tethered directly to weight (s) or band(s) W, 81 to perform an exercise.

Referring now to FIGS. 1A, 1B, 1C, 1D, and 10E by way of example, and not limitation, there is illustrated an example embodiment of push and pull exercise device 10, according to this select embodiment. Push and pull exercise device 10, 10A may be include a flat lateral or horizontal member, such as planar member 20 having first planar end 21 and second planar end 22. Planar member 20 may include upper surface 31 (top side), lower surface 32 (under side), and first or front side edge 41. Moreover, planar member 20 may include a hook, loop, or the like, such as ringlet 50 affixed or removeably affixed to planar member 20 proximate (close in space) center line CL between first planar end 21 and second planar end 22.

It is contemplated herein that upper surface 31 from end-to-end, such as first planar end 21 and second planar end 22, may be flat, planar, arched, curved, contoured, stepped, or the like.

It is contemplated herein that first or front side edge 41 may be rounded, arched, or curved to fit a user's hand.

It is further contemplated herein that ringlet 50 may include a ring 51, D-Ring, square, or any other shape, may have a stub or linear extension 52 having a first or one end and a second or another end, and may be affixed or removeably affixed whether welded, adhesive, formed, nut and bolt, pinned, or any other means to affix or removeably affix ringlet 50 thereto planar member 20 and elongate ringlet 50 above planar member 20.

In use, push and pull exercise device 10, 10A may be attached or removeably affixed to an elongated connector, such as cable CB, 82, cabled weight system CWS, or tethered directly to weight(s) or band(s) W, 81 via an attachment device or quick connector, such as clip C, 83 and cable CB, 82 or the like to enable a user to exercise using push and pull exercise device 10 and having resistance provided by cable CB, 82, cabled weight system CWS, tethered directly to weight(s) or band(s) W, 81 or the like.

A user may utilize a variety of hand positions to engage with push and pull exercise device 10, 10A and indirectly cable CB, 82, cabled weight system CWS, tethered directly to weight(s) or band(s) W, 81 or the like. For example, in FIG. 1B a user may position their left L and right R hand fingers F or fingers F and palm P, or palm P thereon upper surface 31 of planar member 20 on each side of ringlet 50 and push/pull down PD or push up PU, thus exercising triceps, lats, front and rear deltoids, and/or forearm muscles or sets of muscles, or a specific range or section of those muscles.

Figure 1C:
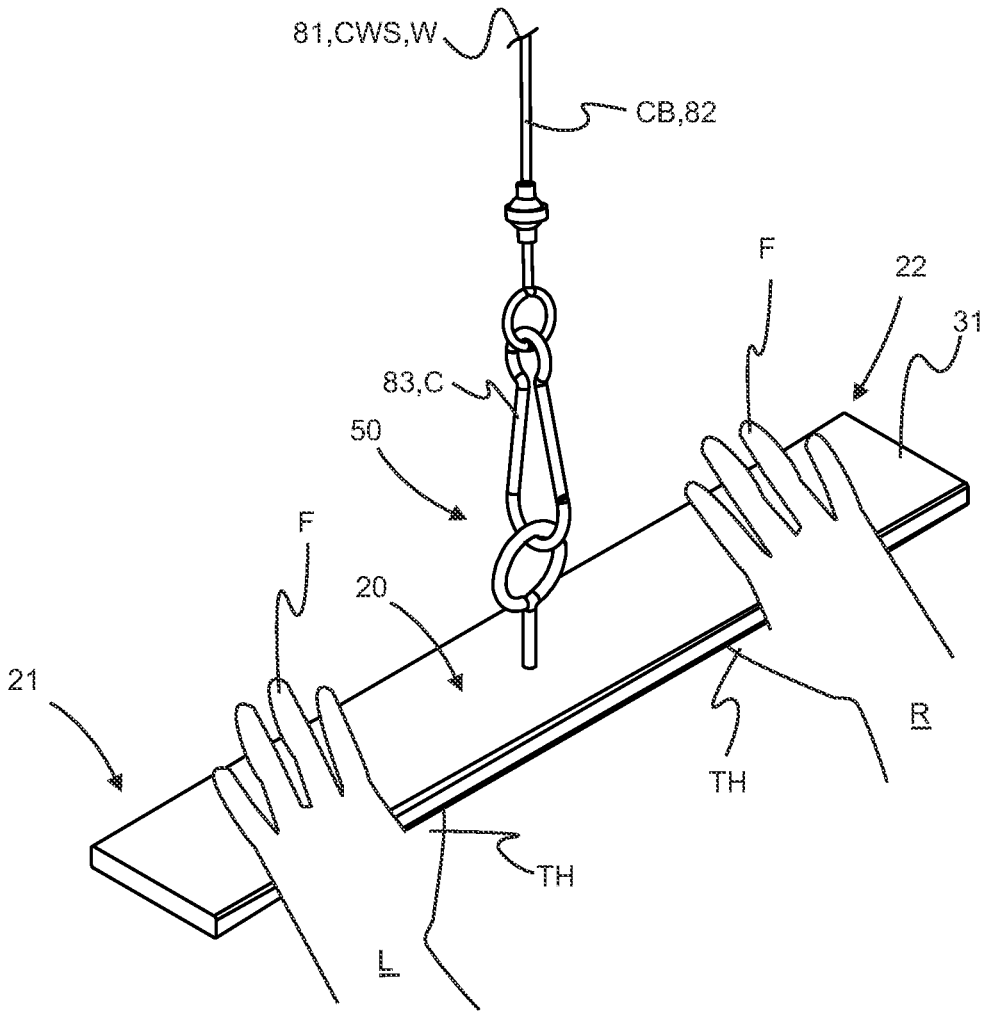
FIG. 1C is a perspective side view of the push and pull exercise device shown in use by contact with the palm side down of out stretched fingers and/or palm of both left and right hands according to an alternate embodiment of the instant disclosure of FIG. 1A.

Alternatively, for example, in FIG. 1C a user may position either their left L and right R hand fingers F or fingers F and palm P, or palm P thereon upper surface 31 of planar member 20 on each side of ringlet 50, may position either their left L and right R hand fingers F or fingers F and palm P, and position user thumb TH (left hand fingers and thumb, right hand fingers and thumb, herein) thereon lower surface 32 of planar member 20 with planar member 20 sandwiched there between on each side of ringlet 50, and push/pull down PD or push up PU, thus exercising triceps, lats, front and rear deltoids, and/or forearm muscles or sets of muscles, or a specific range or section of those muscles.

Figure 1D:
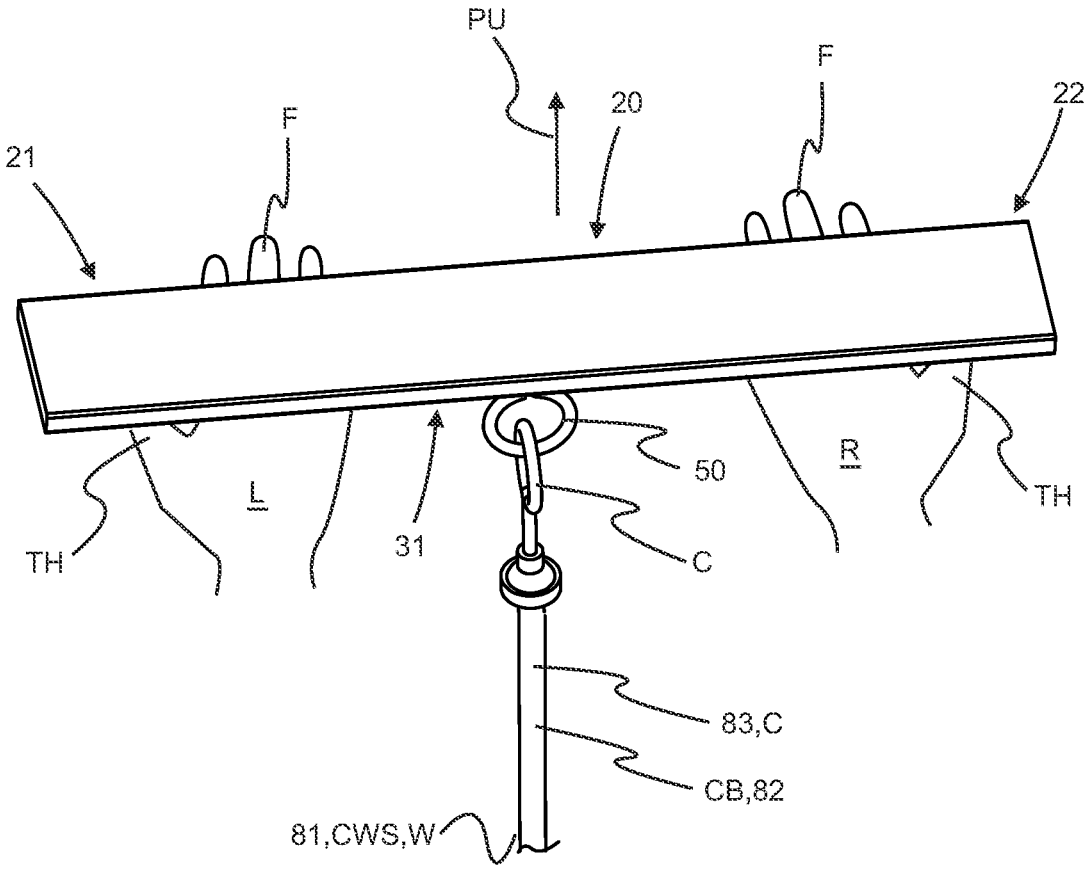
FIG. 1D is a perspective side view of the push and pull exercise device shown in use by contact with the palm side up of out stretched fingers and/or palm of both left and right hands according to an alternate embodiment of the instant disclosure of FIG. 1A.

Alternatively, for example, in FIG. 1D (similar to 1B), planar member 20 may be rotated 180 degrees to an upside down position and a user may position either their left L and right R hand fingers F or fingers F and palm P, or palm P thereon upper surface 31 of planar member 20 on each side of ringlet 50 and pull up PU, thus exercising biceps, shoulders, and/or forearm muscles or sets of muscles, or a specific range or section of those muscles.

It is contemplated herein that FIG. 1D may utilize the grip configuration of FIG. 1C.

Figure 1E:
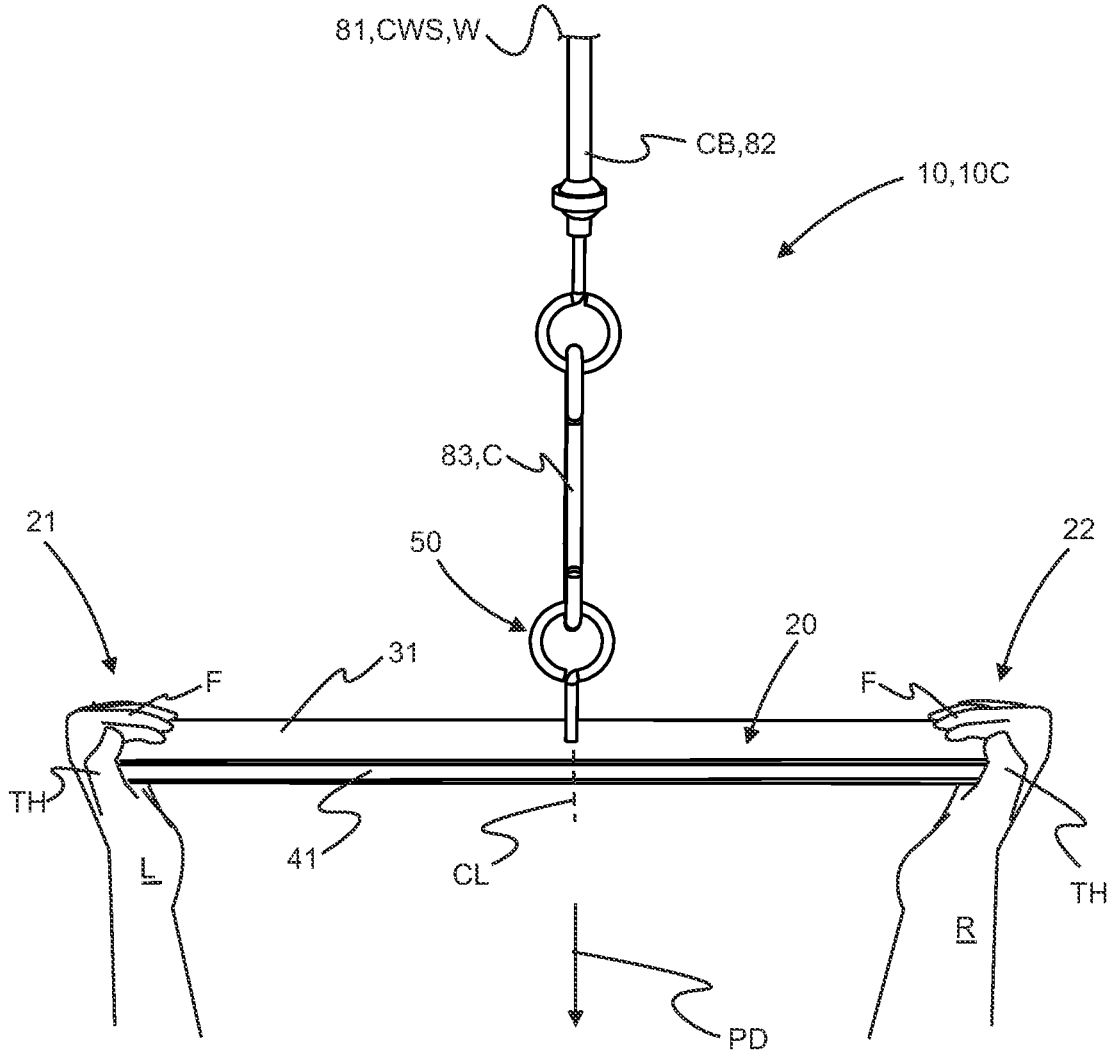
FIG. 1E is a perspective side view of the push and pull exercise device shown in use by contact with the palm side down of out stretched fingers and/or palm of both left and right hands positioned on ends according to an alternate embodiment of the instant disclosure of FIG. 1A.

Alternatively, for example, in FIG. 1E a user may position either their left L and right R hand fingers F or fingers F and palm P, or palm P thereon upper surface 31 of planar member 20 on each end, first end 21, and second end 22 of planar member 20, may position either their left L and right R hand fingers F or fingers F and palm P on each end, first end 21, and second end 22 of planar member 20, and position user thumb TH (left hand fingers and thumb, right hand fingers and thumb, herein) thereon lower surface 32 of planar member 20 on each end, first end 21, and second end 22 of planar member 20 with planar member 20 sandwiched there between on each side of ringlet 50, and pull down PD or push up PU, thus exercising triceps, lats, front and rear deltoids, and/or forearm muscles or sets of muscles, or a specific range or section of those muscles.

It is further contemplated that additional hand grips, angles of planar member 20 relative to user, and positions of planar member 20 relative to user are contemplated herein.

It is further contemplated herein that planar member 20 typically is constructed of sturdy materials such as steel, aluminum, wood, laminated wood or fiber or other sturdy material and is designed to withstand the weight and ensure stability during the push/pull down PD or push up PU process.

Figure 2A:
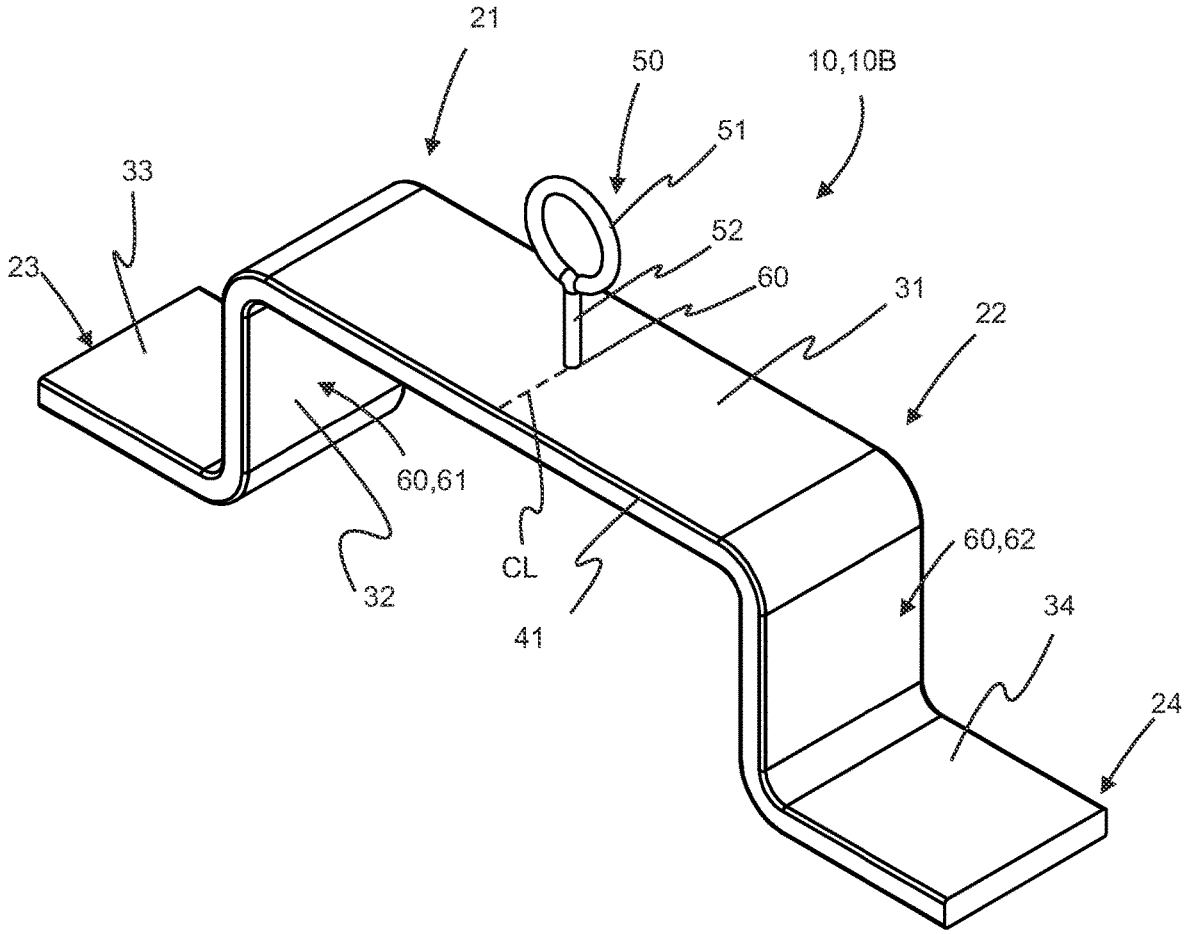
FIG. 2A is a perspective side view of the push and pull exercise device according to select alternate embodiments of the instant disclosure.
Figure 2B:
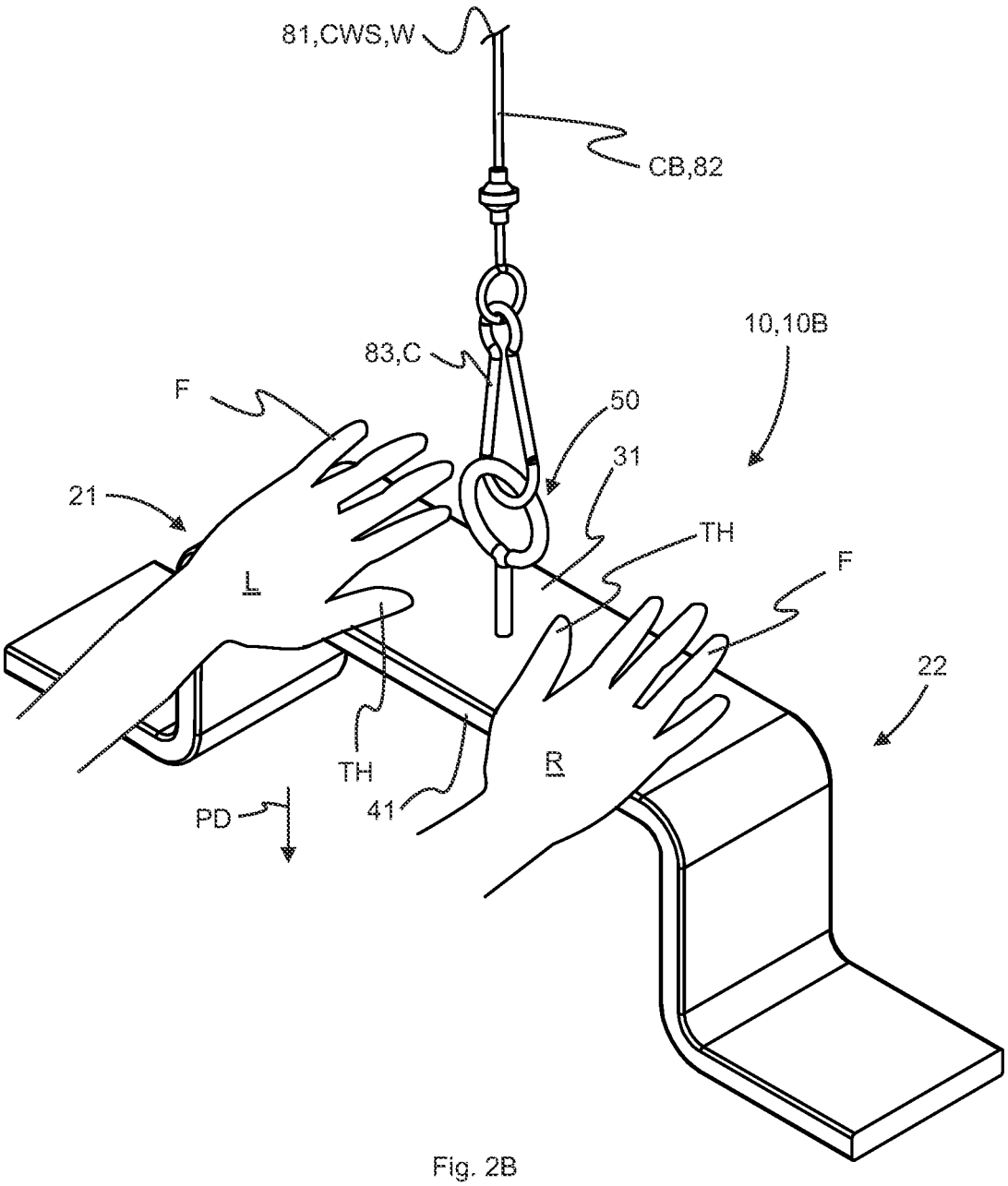
FIG. 2B is a perspective side view of the push and pull exercise device shown in use with the underside of outstretched fingers and the thumb of palm down positioned on the upper level according to select embodiments of the instant disclosure of FIG. 2A.
Figure 2C:
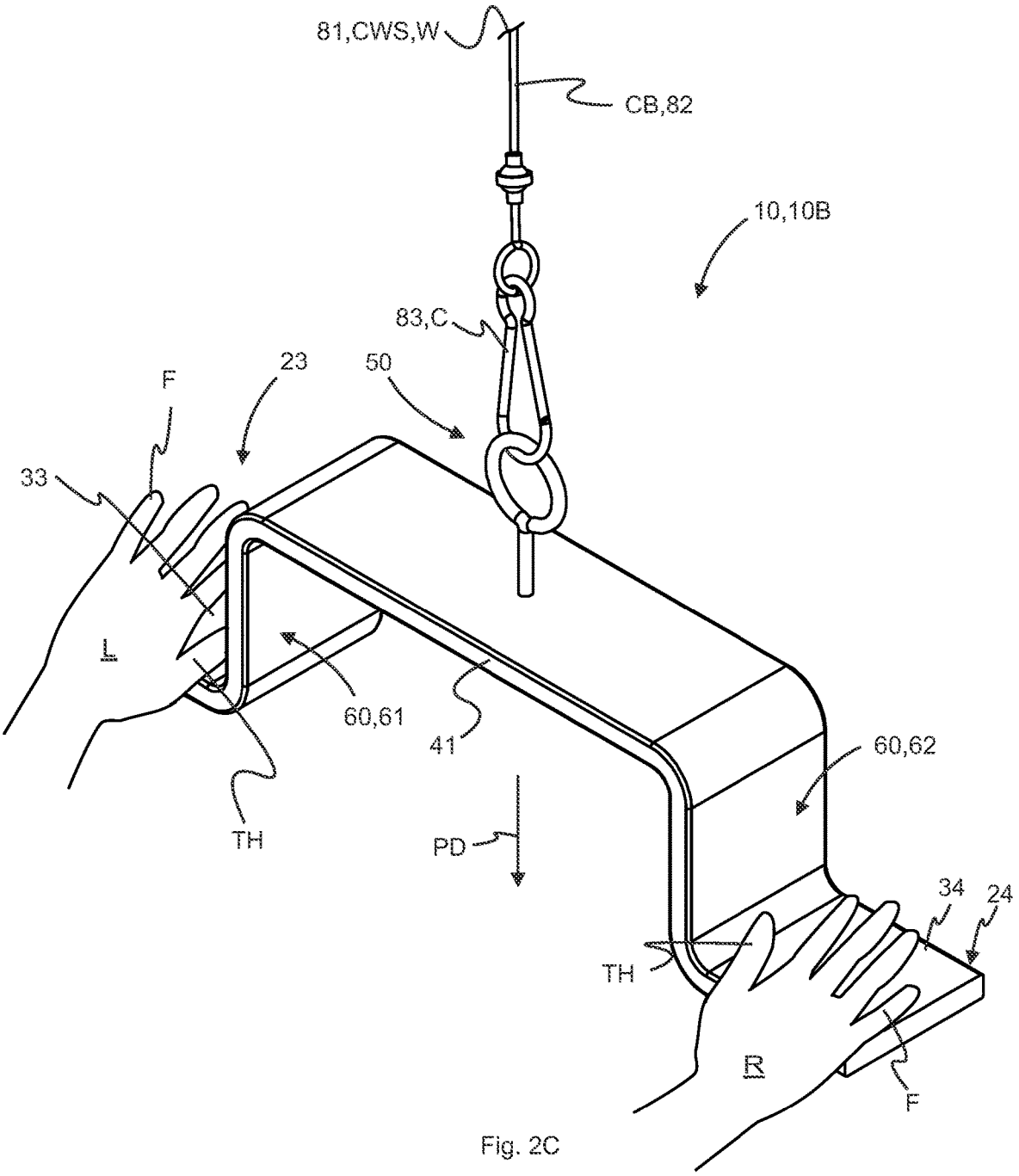
FIG. 2C is a perspective side view of the push and pull exercise device shown in use with the underside of outstretched fingers and the thumb of palm down positioned on the lower level according to select embodiments of the instant disclosure of FIG. 2A.

Referring now to FIGS. 2A, 2B, and 2C, by way of example, and not limitation, there is illustrated an example embodiment of push and pull exercise device 10, according to this select embodiment. Push and pull exercise device 10, 10B may be include a flat lateral or horizontal member(s), such as planar member 20 having first planar end 21 and second planar end 22. Planar member 20 may include first upper surface 31, first lower surface 32, and first or front side edge 41. Moreover, planar member 20 may include a hook, loop, or the like, such as ringlet 50 affixed or removeably affixed to planar member 20 proximate center line CL between first planar end 21 and second planar end 22. Furthermore, planar member 20 may include vertical support sections 60, such as first vertical support 61 and second vertical support 62. First vertical support 61 may be positioned proximate and extend therefrom first planar end 21 to support third upper surface 33 having third planar end 23, and second vertical support 62 may be positioned proximate and extend therefrom second planar end 22 to support fourth upper surface 34 having fourth planar end 24.

It is contemplated herein that upper surface 31, third upper surface 33, and fourth upper surface 34 from end-to-end, such as first planar end 21, second planar end 22, third planar end 23, and fourth planar end 24 may be flat, planar, arched, curved, contoured, stepped, or the like.

It is further contemplated herein that ringlet 50 may include a ring 51, D-Ring, square, or any other shape, may have a stub or linear extension 52, and may be affixed or removeably affixed whether welded, adhesive, formed, nut and bolt, pinned, or any other means to affix or removeably affix ringlet 50 thereto planar member 20.

In use, push and pull exercise device 10, 10B may be attached or removeably affixed to cabled weight system CWS, or tethered directly to weight(s) W, 81 via an attachment device, such as clip C, 83 and cable CB, 82 or the like to enable a user to exercise using push and pull exercise device 10, 10B and having resistance provided by cabled weight system CWS, or tethered directly to weight(s) W, 81 or the like.

A user may utilize a variety of hand positions to engage with push and pull exercise device 10, 10B and indirectly cable CB, 82, cabled weight system CWS, tethered directly to weight(s) or band(s) W, 81 or the like. For example, in FIG. 2B a user may position either their left L and right R hand fingers F or fingers F and palm P, or palm P, thereon third upper surface 33 and fourth upper surface 34 of planar member 20, or sandwiched first or front side edge 41 there between on each side of ringlet 50 and push/pull down PD or push up PU, thus exercising biceps, wrist, triceps, lats, front and rear deltoids, and/or forearm muscles or sets of muscles, or a specific range or section of those muscles.

Alternatively, for example, in FIG. 2C a user may position either their left L and right R hand fingers F or fingers F and palm P, or palm P, thereon upper surface 31 of planar member 20, or sandwiched first or front side edge 41 there between on each side of ringlet 50 and push/pull down PD or push up PU, thus exercising biceps, wrist, triceps, lats, front and rear deltoids, and/or forearm muscles or sets of muscles, or a specific range or section of those muscles.

It is contemplated herein as shown in FIG. 1D that planar member 20 of push and pull exercise device 10, 10B may be rotated 180 degrees to an upside down position and a user may position either their left L and right R hand fingers F or fingers F and palm P, or palm P thereon upper surface 31, or alternatively on third upper surface 33 and fourth upper surface 34 of planar member 20 on each side of ringlet 50 and pull up PU, thus exercising biceps, shoulders, and/or forearm muscles or sets of muscles, or a specific range or section of those muscles.

It is further contemplated that additional hand grips, angles of planar member 20 relative to user, and positions of planar member 20 relative to user are contemplated herein.

It is further contemplated herein that planar member 20 typically is constructed of sturdy materials such as steel, aluminum, wood, laminated wood or fiber or other sturdy material and is designed to withstand the weight and ensure stability during the push/pull down PD or push up PU process.

It is further contemplated herein that vertical support sections 60, such as first vertical support 61 and second vertical support 62 may be linear and/or angularly adjusted expanding the range between first upper surface 31, and third upper surface 33 and fourth upper surface 34.

Figure 3A:
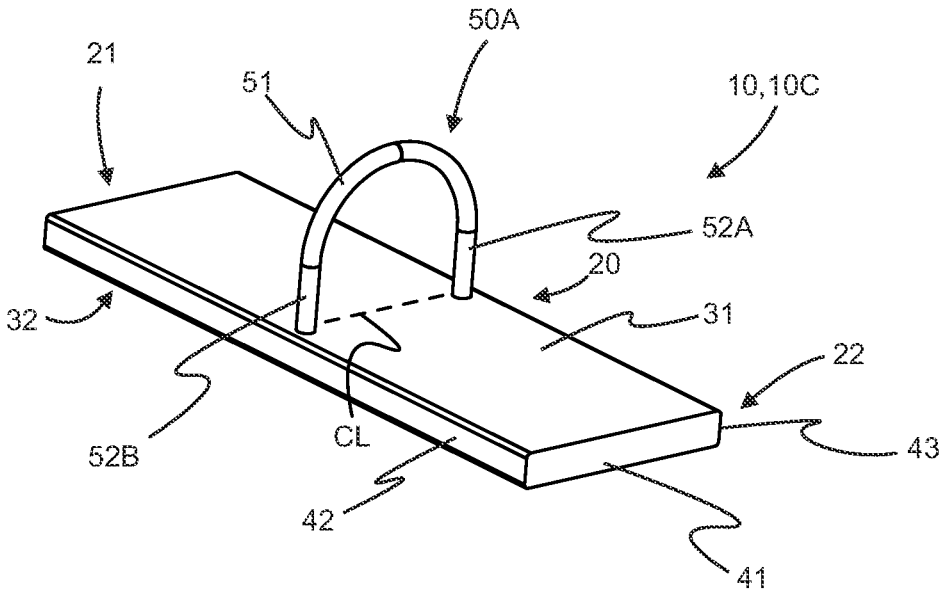
FIG. 3A is a perspective side view of the push and pull exercise device according to select alternate embodiments of the instant disclosure.
Figure 3B:
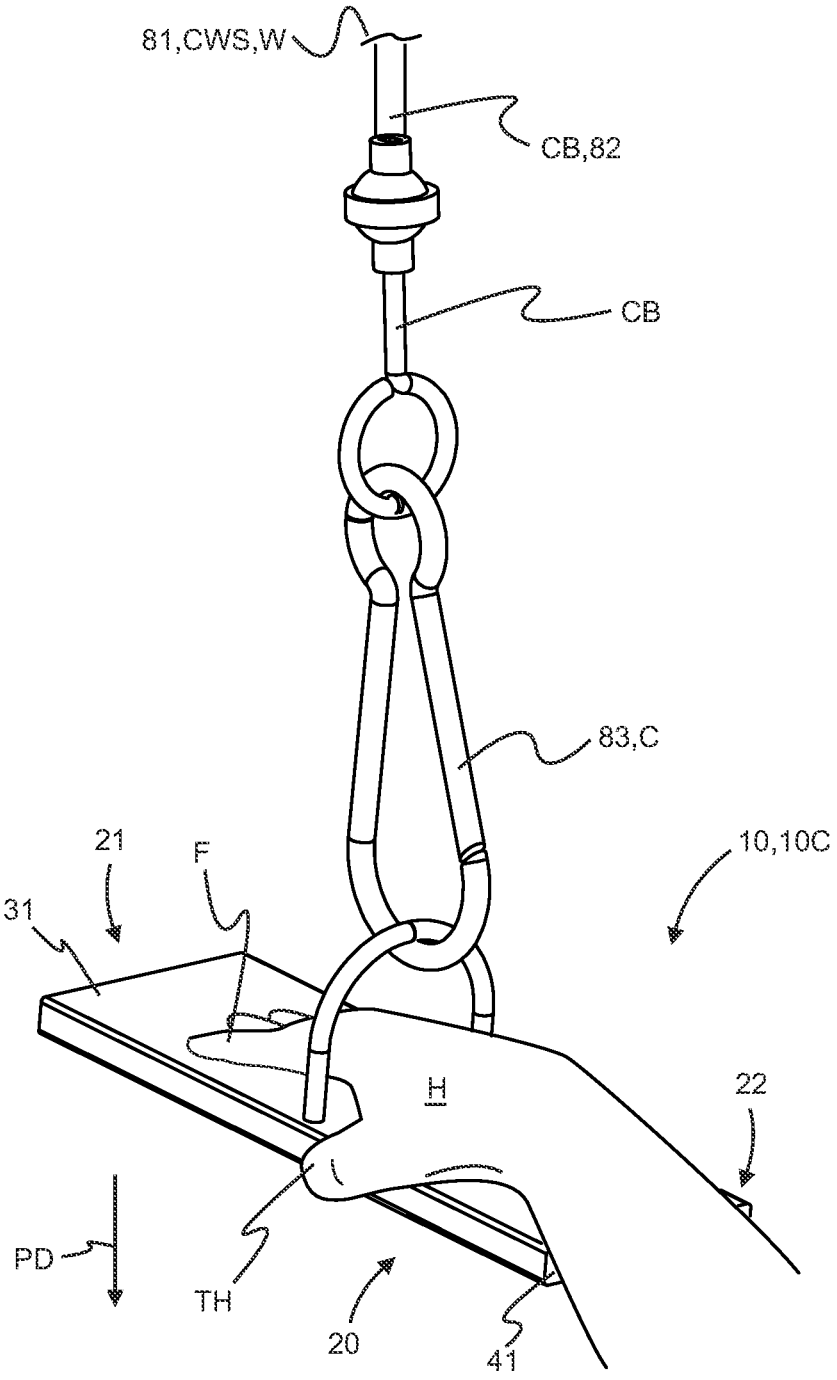
FIG. 3B is a perspective side view of the push and pull exercise device shown in use with the underside of outstretched fingers and the thumb of palm down positioned on the upper level according to select embodiments of the instant disclosure of FIG. 3A.

Referring now to FIGS. 3A and 3B, by way of example, and not limitation, there is illustrated an example embodiment of push and pull exercise device 10, according to this select embodiment. Push and pull exercise device 10, 10C may be include a flat lateral or horizontal member(s), such as planar member 20 having first planar end 21 and second planar end 22. Planar member 20 may include first upper surface 31, first lower surface 32, and first or front side edge 41. Moreover, planar member 20 may include a hook, loop, ringlet, D-ring, horseshoe loop or the like, such as ringlet 50A affixed or removeably affixed to planar member 20 proximate center line CL between first planar end 21 and second planar end 22. Furthermore, ringlet 50A may include half-ring 51, D-Ring, square, or any other shape, may have a pair of stubs or linear extension 52A, 52B, and may be affixed or removeably affixed whether welded, adhesive, formed, nut and bolt, pinned, or any other means to affix or removeably affix ringlet 50A thereto planar member 20 proximate second side edge 42 and third side edge 43, respectively.

It is contemplated herein that upper surface 31 from end-to-end, such as first planar end 21 and second planar end 22 may be flat, planar, arched, curved, contoured, stepped, or the like.

In use, push and pull exercise device 10, 10C may be attached or removeably affixed to cable CB, 82, cabled weight system CWS, tethered directly to weight(s) or band (s) W, 81 via an attachment device, such as clip C, 83 or the like to enable a user to exercise using push and pull exercise device 10, 10C and having resistance provided by cable CB, 82, cabled weight system CWS, tethered directly to weight (s) or band(s) W, 81 or the like.

A user may utilize a variety of hand positions to engage with push and pull exercise device 10, 10C and indirectly cable CB, 82, cabled weight system CWS, tethered directly to weight(s) or band(s) W, 81 or the like. For example, in FIG. 3B a user may position (user positions) either their left L or right R hand fingers F or fingers F and palm P, or palm P (right hand fingers, right hand thumb, right hand palm, left hand fingers, left hand thumb, left hand palm, herein), thereon first upper surface 31 of planar member 20, or sandwiched first or front side edge 41, there between on each side of ringlet 50 and push/pull down PD or push up PU, thus exercising biceps, wrist, triceps, lats, front and rear deltoids, and/or forearm muscles or sets of muscles, or a specific range or section of those muscles.

Alternatively, for example, in FIG. 2C a user may position either their left L and right R hand fingers F or fingers F and palm P, or palm P, thereon upper surface 31 of planar member 20, or sandwiched first or front side edge 41, second side edge 42 or third side edge 43 there between on each side of ringlet 50 and push/pull down PD or push up PU, thus exercising biceps, wrist, triceps, lats, front and rear deltoids, and/or forearm muscles or sets of muscles, or a specific range or section of those muscles.

It is contemplated herein as shown in FIG. 1D that planar member 20 of push and pull exercise device 10, 10C may be rotated 180 degrees to an upside down position and a user may position either their left L and right R hand fingers F or fingers F and palm P, or palm P or alternatively on first upper surface 31 of planar member 20 on each side of ringlet 50 and pull up PU, thus exercising biceps, shoulders, and/or forearm muscles or sets of muscles, or a specific range or section of those muscles.

It is further contemplated that additional hand grips, angles of planar member 20 relative to user, and positions of planar member 20 relative to user are contemplated herein.

It is further contemplated herein that planar member 20 typically is constructed of sturdy materials such as steel, aluminum, wood, laminated wood or fiber or other sturdy material and is designed to withstand the weight and ensure stability during the push/pull down PD or push up PU process.

Figure 4A:
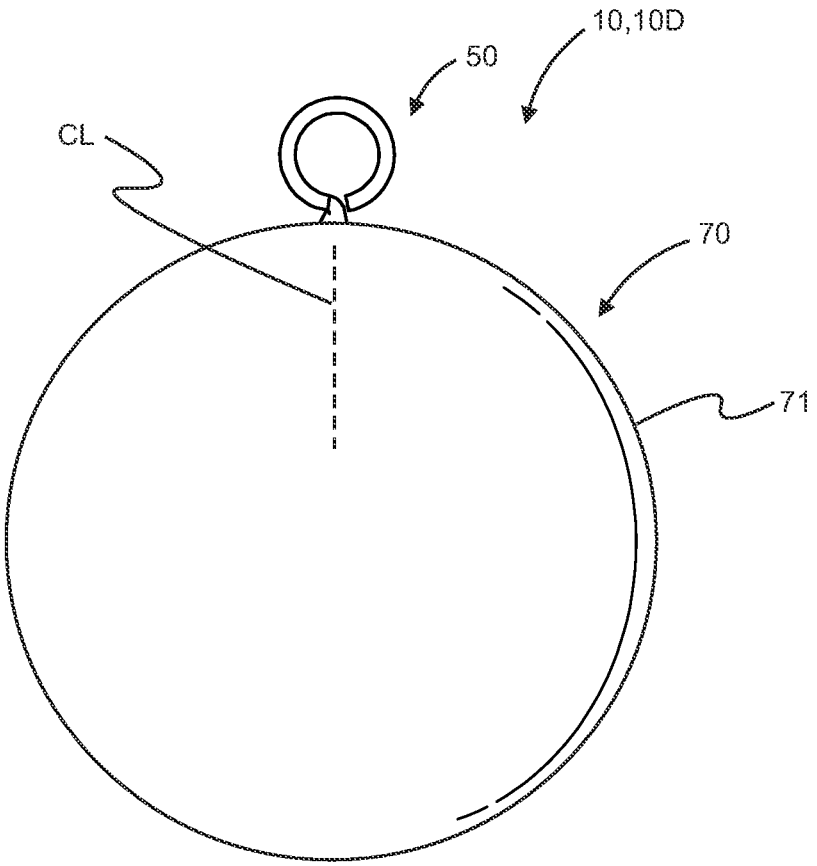
FIG. 4A is a perspective side view of the push and pull exercise device according to select alternate embodiments of the instant disclosure.
Figure 4B:
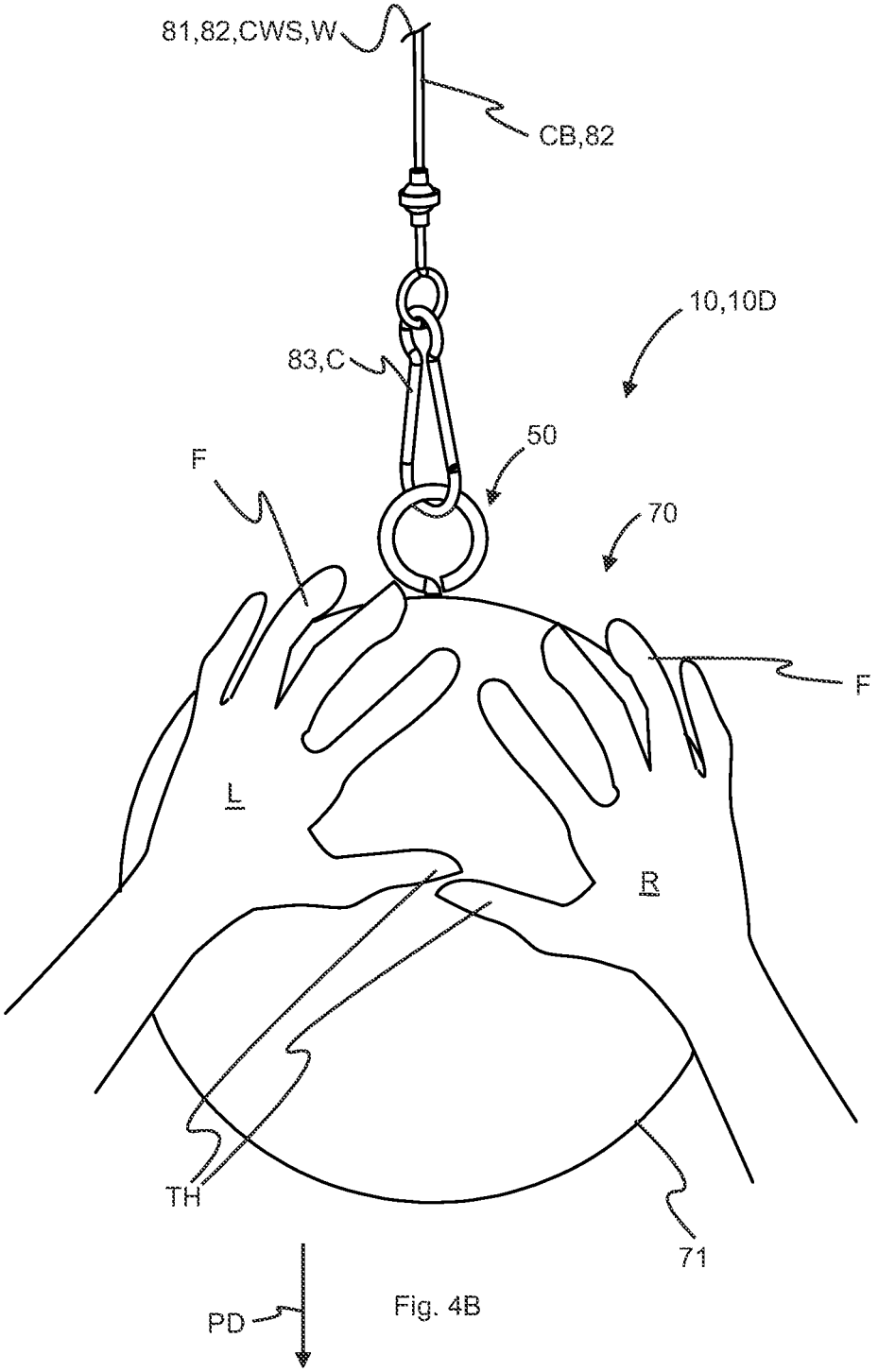
FIG. 4B is a perspective side view of the push and pull exercise device shown in use with the underside of outstretched fingers and the thumb of palm down positioned on the outer surface according to select embodiments of the instant disclosure of FIG. 4A.

Referring now to FIGS. 4A and 4B, by way of example, and not limitation, there is illustrated an example embodiment of push and pull exercise device 10, according to this select embodiment. Push and pull exercise device 10, 10D may be include a rounded, arched or other curved surface, such as ball 70 having curved surface 71. Moreover, ball 70 may include a hook, loop, ringlet, D-ring, horseshoe loop or the like, such as ringlet 50 affixed or removeably affixed to ball 70 proximate center line CL, and may be affixed or removeably affixed whether welded, adhesive, formed, nut and bolt, pinned, or any other means to affix or removeably affix ringlet 50 thereto ball 70.

It is contemplated herein that curved surface 71 may be arched, curved, contoured, stepped, or the like.

In use, push and pull exercise device 10, 10D may be attached or removeably affixed to cabled weight system CWS, or tethered directly to weight(s) W, 81 via an attachment device, such as clip C, 83 and cable CB, 82 or the like to enable a user to exercise using push and pull exercise device 10, 10D and having resistance provided by cabled weight system CWS, or tethered directly to weight(s) W, 81 or the like.

A user may utilize a variety of hand positions to engage with push and pull exercise device 10, 10D and indirectly cable CB, 82, cabled weight system CWS, tethered directly to weight(s) or band(s) W, 81 or the like. For example, in FIG. 4B a user may position either their left L or right R hand fingers F or fingers F and palm P, or palm P, thereon curved surface 71 of ball 70 and push/pull down PD or push up PU, thus exercising biceps, wrist, triceps, lats, front and rear deltoids, and/or forearm muscles or sets of muscles, or a specific range or section of those muscles.

It is contemplated herein as shown in FIG. 1D that ball 70 of push and pull exercise device 10, 10D may be rotated 180 degrees to an upside down position and a user may position either their left L and right R hand fingers F or fingers F and palm P, or palm P or alternatively on curved surface 71 of ball 70 and pull up PU, thus exercising biceps, shoulders, and/or forearm muscles or sets of muscles, or a specific range or section of those muscles.

It is further contemplated that additional hand grips, angles of curved surface 71 of ball 70 relative to user, and positions of curved surface 71 of ball 70 relative to user are contemplated herein.

It is further contemplated herein that curved surface 71 of ball 70 typically is constructed of sturdy materials such as plastic, rubber, steel, aluminum, wood, laminated wood or fiber or other sturdy material and is designed to withstand the weight and ensure stability during the push/pull down PD or push up PU process.

With respect to the above description then, it is to be realized that the optimum dimensional relationships, to include variations in size, materials, shape, form, position, movement mechanisms, function and manner of operation, assembly and use, are intended to be encompassed by the present disclosure.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Moreover, the present disclosure has been described in detail, it should be understood that various changes, substitutions and alterations can be made thereto without departing from the spirit and scope of the disclosure as defined by the appended claims. Accordingly, the present disclosure is not limited to the specific embodiments illustrated herein but is limited only by the following claims.

The invention claimed is:

1. A push and pull exercise device, said push and pull exercise device comprising:

a planar member having a first planar end and a second planar end with a center line there between said first planar end and said second planar end, said planar member having an upper surface and a front side edge;

a ringlet affixed to said planar member proximate to said center line between said first planar end and said second planar end; and a first vertical support and a second vertical support, said first vertical support positioned proximate to and extending therefrom said first planar end to support a third upper surface having a third planar end, and said second vertical support positioned proximate to and extending therefrom said second planar end to support a fourth upper surface having a fourth planar end.

2. The push and pull exercise device of claim 1, wherein said ringlet further comprising a linear extension affixed on one end to said ringlet and on another end to said planar member.

3. The push and pull exercise device of claim 1, wherein said ringlet further comprising an elongated connector affixed on one end to said ringlet and on another end to a weight.

4. The push and pull exercise device of claim 3, wherein said one end of said elongated connector further comprising a clip to removeably affix to said ringlet.

5. The push and pull exercise device of claim 1, wherein said upper surface of said planar member is configured to enable a user to position a left and a right hand fingers and thumb thereon said upper surface of said planar member.

6. The push and pull exercise device of claim 1, wherein said upper surface of said planar member is configured to enable a user to position a left and a right hand fingers, thumb, and palm thereon.

7. The push and pull exercise device of claim 1, wherein said planar member further comprising a lower surface.

8. The push and pull exercise device of claim 7, wherein said upper surface of said planar member is configured to enable a user to position a left and a right hand fingers thereon and said lower surface is configured to enable said user to position a left and a right hand thumb thereon.

9. The push and pull exercise device of claim 1, wherein said third upper surface is configured to enable a user to position a left hand fingers and thumb thereon and said fourth upper surface is configured to enable said user to position a right hand fingers and thumb thereon.

10. The push and pull exercise device of claim 1, wherein said third upper surface is configured to enable a user to position a left hand fingers, thumb, and palm thereon and said fourth upper surface is configured to enable said user to position a right hand fingers, thumb, and palm thereon.

11. The push and pull exercise device of claim 1, wherein said third upper surface and said fourth upper further comprising a lower surface.

12. The push and pull exercise device of claim 11, wherein said third upper surface is configured to enable a user to position a left hand fingers thereon, said fourth upper surface is configured to enable said user to position a right hand fingers thereon, and said lower surface is configured to enable said user to position a left hand thumb thereon and a right hand thumb thereon.

* * * * *